US010770248B2

(12) United States Patent
Oh et al.

(10) Patent No.: US 10,770,248 B2
(45) Date of Patent: Sep. 8, 2020

(54) MOLDED CASE CIRCUIT BREAKER

(71) Applicant: LSIS CO., LTD., Anyang-si, Gyeonggi-do (KR)

(72) Inventors: Kihwan Oh, Anyang-si (KR); Kyunghwan Oh, Anyang-si (KR)

(73) Assignee: LSIS CO., LTD., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 16/286,925

(22) Filed: Feb. 27, 2019

(65) Prior Publication Data

US 2019/0348236 A1 Nov. 14, 2019

(30) Foreign Application Priority Data

May 11, 2018 (KR) ..... 10-2018-0054443

(51) Int. Cl.
*H01H 33/06* (2006.01)
*H01H 33/53* (2006.01)

(52) U.S. Cl.
CPC ..... *H01H 33/06* (2013.01); *H01H 33/53* (2013.01)

(58) Field of Classification Search
CPC ..... H01H 9/30; H01H 33/06; H01H 33/04; H01H 33/08; H01H 33/53; H01H 71/24; H01H 9/32; H01H 1/2058; H01H 73/045; H01H 73/18; H01H 71/2472
USPC ..... 218/117, 113, 110, 41, 37, 31, 30; 200/151, 50.34; 335/16, 201, 172
See application file for complete search history.

(56) References Cited

U.S. PATENT DOCUMENTS 4,677,266 A * 6/1987 Belbel ..... H01H 9/32 218/117
4,801,772 A * 1/1989 Bratkowski ..... H01H 9/32 218/117
4,849,591 A * 7/1989 Comtois ..... H01H 3/60 218/117
4,880,948 A * 11/1989 Kandatsu ..... H01H 9/32 218/117

(Continued)

FOREIGN PATENT DOCUMENTS

CN 102376505 A 3/2012
CN 106252178 A 12/2016

(Continued)

OTHER PUBLICATIONS

Translation KR200411524 (original document published Mar. 8, 2006) (Year: 2006).*

(Continued)

*Primary Examiner* — William A Bolton
(74) *Attorney, Agent, or Firm* — K&L Gates LLP

(57) ABSTRACT

The present disclosure relates to a molded case circuit breaker, and more particularly, to a contact unit of a molded case circuit breaker. A molded case circuit breaker according to an embodiment of the present disclosure may include a fixed contact; a movable contact rotatably provided on a shaft body to be brought into contact with or separated from the fixed contact; and an insulating barrier that enters between the fixed contact and the movable contact during interruption, wherein the insulating barrier is coupled to the movable contact to rotate along a circumferential surface of a shaft body.

11 Claims, 10 Drawing Sheets

(56) References Cited

U.S. PATENT DOCUMENTS

| | | | | |
|---|---|---|---|---|
| 4,943,691 | A * | 7/1990 | Mertz | H01H 9/32 218/117 |
| 7,977,592 | B2 | 7/2011 | Shmukler et al. | |
| 2014/0048513 | A1 | 2/2014 | Sato et al. | |

FOREIGN PATENT DOCUMENTS

| | | | |
|---|---|---|---|
| CN | 207074608 | U | 3/2018 |
| EP | 0560696 | B1 | 5/1996 |
| JP | S59025142 | A | 2/1984 |
| JP | 2005235670 | A | 9/2005 |
| JP | 2014038751 | A | 2/2014 |
| KR | 200411524 | | 3/2006 |
| KR | 100832325 | B1 | 5/2008 |

OTHER PUBLICATIONS

Korean Office action for related Korean Application No. 10-2018-0054443; action dated Mar. 28, 2019; (4 pages).
Database WPI Week 201224; Thomson Scientific, London, GB; AN 2012-D73057 XP002794477; (2 pages).
European Search Report for related European Application No. 19159779.8; action dated Oct. 10, 2019; (9 pages).

* cited by examiner

MOLDED CASE CIRCUIT BREAKER

CROSS-REFERENCE TO RELATED APPLICATIONS

Pursuant to 35 U.S.C. § 119(a), this application claims the benefit of earlier filing date and right of priority to Korean Application No. 10-2018-0054443, filed on May 11, 2018, the contents of which is incorporated by reference herein in its entirety.

BACKGROUND OF THE INVENTION

1. Field of the Invention

The present disclosure relates to a molded case circuit breaker, and more particularly, to a contact unit of a molded case circuit breaker.

2. Description of the Conventional Art

In general, a molded case circuit breaker (MCCB) is an electric device that automatically shuts off a circuit during an overload condition or a short-circuit accident to protect the circuit and load.

The molded case circuit breaker includes a terminal unit capable of being connected to a power source or a load, a contact unit including a fixed contact and a movable contact brought into contact with or separated from the fixed contact to connect or disconnect a circuit, a switching mechanism that moves the movable contact to provide power required for the switching of the circuit, a trip unit that senses an overcurrent or a short-circuit current flowing on the circuit to induce a trip operation of the switching mechanism, and an arc-extinguishing unit for extinguishing an arc generated when an abnormal current is interrupted, and the like.

FIG. 1 illustrates an internal structural view of a molded case circuit breaker according to the related art. A molded case circuit breaker according to the related art includes a fixed contact 1 and a movable contact 2 constituting a contact unit provided to connect or disconnect a circuit transmitted from a power source side to a load side within a case 9 formed of an insulating material, a switching mechanism unit 4 that provides power capable of rotating the movable contact 2, an arc-extinguishing unit 3 provided to extinguish an arc generated when a fault current is interrupted, and a trip unit 5 that detects an abnormal current to trip the switching mechanism, and the like.

When a fault current flows in the circuit, a trip operation is carried out to separate the movable contact 2 from the fixed contact 1 to disconnect the flow of the current, and an arc is generated between the contactors 1, 2. At this time, the magnitude (intensity) of the arc is proportional to the magnitude of the current. An arc is a discharge in which gas in the air instantaneously reaches a plasma state by a voltage, and the arc center temperature reaches 8,000-12,000° C. and has an explosive expansion pressure. As a result, it has characteristics in that the contactors 1, 2 are melted and consumed, and neighboring parts are deteriorated and destroyed, and thus the continuity or non-continuity of the arc greatly affects the performance and durability of the circuit breaker. Therefore, the arc must be quickly interrupted, extinguished and discharged from the arc-extinguishing unit 3.

In this manner, in a molded case circuit breaker, an operation of processing an arc is a main purpose in interrupting a fault current to protect a product, a load and a line and directly affects the performance of the circuit breaker.

FIGS. 2 and 3 illustrate a base assembly of a molded case circuit breaker according to the related art. The base assembly includes a contact unit and an arc-extinguishing unit. FIG. 2 shows a conduction state, and FIG. 3 shows an interruption state.

The movable contact 2 is coupled to a shaft 6 rotated by receiving a force of the switching mechanism unit 4 to rotate, and a contact unit at which a fixed contact of the fixed contact 1 and a movable contact of the movable contact 2 are brought into contact with each other is disposed inside a lateral plate of the arc-extinguishing unit 3.

An arc-extinguishing device mainly used in the arc-extinguishing unit 3 of the circuit breaker is a cold cathode type extinguishing chamber using a metal plate. The arc-extinguishing unit 3 is formed by vertically arranging grids 3*b* made of metal plates having a V-shaped groove between a pair of lateral plates 3*a* typically spaced apart from each other at appropriate intervals. When the contactors 1, 2 are open to generate an arc (A) during interruption, the arc moves from the lateral plates 3*a* to the grids 3*b*. The arc is cooled by the grids 3*b* and divided into short arcs between the respective grids 3*b* to increase the arc voltage and reduce the current. Furthermore, a case internal pressure rises due to extinguishable gas generated in an insulating plate (not shown) constituting the arc-extinguishing unit 3 to compress the arc to a high pressure and suppress the release of free electrons, thereby rapidly extinguishing the arc (A) and restoring the gap voltage.

As described above, the molded case circuit breaker according to the related art induces, extends and cools an arc (A) generated between the fixed contact and the movable contact to the grids 3*b* during an interruption operation due to the occurrence of a fault current to extinguish the arc, and such a sequential opening mechanism provides a possibility that the movable contact and the fixed contact are exposed to the arc for a long time during an arc interruption operation to cause damage and destroy insulation around the shaft. As a result, interruption performance may decrease to cause a temperature rise.

SUMMARY OF THE INVENTION

The present disclosure has been made to solve the above-mentioned problems, and an object of the present disclosure is to provide a molded case circuit breaker for effectively extinguishing an arc generated at a contact unit during interruption.

Another object of the present disclosure is to provide a molded case circuit breaker for improving insulation performance around a shaft assembly.

A molded case circuit breaker according to an embodiment of the present disclosure may include a fixed contact; a movable contact rotatably provided on a shaft body to be brought into contact with or separated from the fixed contact; and an insulating barrier that enters between the fixed contact and the movable contact during interruption, wherein the insulating barrier is coupled to the movable contact to rotate along a circumferential surface of a shaft body.

Here, an end portion of the insulating barrier may be coupled to the movable contact and the other end portion thereof may form a free end.

Furthermore, a guide portion that guides the other end portion of the insulating barrier may be protruded on part of a base mold provided with the shaft body.

Furthermore, the guide portion may include a pair of protrusion portions spaced apart from each other.

Furthermore a fitting groove may be formed on a rear surface of the movable contact, and one end portion of the insulating barrier may be fitted and coupled to the fitting groove by a fixing pin.

Furthermore, the insulating barrier may be formed of a flexible material and disposed in a shape of surrounding an outer circumferential surface of the shaft body.

Furthermore, a circumferential groove-shaped plate groove may be formed on the shaft body, and a contact plate sliding along the plate groove may be provided in the plate groove.

Furthermore, the plate groove may be formed smaller than a radius of an outer circumferential surface of the shaft body.

Furthermore, an elastic member providing an elastic force in a direction in which the contact plate is brought into contact with the movable contact may be provided in a pin insertion groove of the shaft body.

Furthermore, the insulating barrier may include a cover portion covering an opening portion of the shaft body and an arc interrupting portion extended to one end of the cover portion.

In addition, a mover insertion hole into which the movable contact can be inserted may be formed on the cover portion.

According to a molded case circuit breaker according to an embodiment of the present disclosure, when a fault current is interrupted, an insulating barrier may enter between the fixed contact and the movable contact to cut off an arc in advance. As a result, the arc transferred to the arc-extinguishing unit is reduced to rapidly perform an arc interruption operation and reduce damage to neighboring parts.

Furthermore, the insulating barrier is coupled to the movable contact to operate together with the movable contact, and thus applied not only to general fault current interruption but also to cold current interruption.

In addition, the insulating barrier covers an opening portion of the shaft assembly, and thus insulating performance to an inside of the shaft assembly is improved.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings:

FIGS. 2 and 3 are internal structural views illustrating a base assembly of a molded case circuit breaker according to the related art, wherein FIG. 2 shows a conduction state, and FIG. 3 shows an interruption state;

FIGS. 6 through 8 are perspective views of a base assembly of a molded case circuit breaker according to an embodiment of the present disclosure, in which an interruption process is shown, wherein FIGS. 6 through 8 show a conduction state, an interruption operation progress state, and an interruption complete state, respectively;

FIGS. 11 and 12 are perspective views illustrating a shaft assembly of a molded case circuit breaker according to still another embodiment of the present disclosure, wherein FIG. 12 illustrates a state in which an insulating barrier is separated in FIG. 11;

FIGS. 13 and 14 show an interruption operation during cold current interruption in the embodiment of FIG. 10, wherein FIG. 13 shows a conduction state, and FIG. 14 shows an interruption state.

DETAILED DESCRIPTION OF THE PREFERRED EMBODIMENT

Hereinafter, preferred embodiments of the present disclosure will be described with reference to the accompanying drawings, which are intended to describe the present disclosure in detail to allow a person skilled in the art to easily carry out the invention, but not to mean that the technical concept and scope of the present disclosure are limited thereto.

A molded case circuit breaker according to each embodiment of the present disclosure will be described in detail with reference to the drawings.

Figure 1:
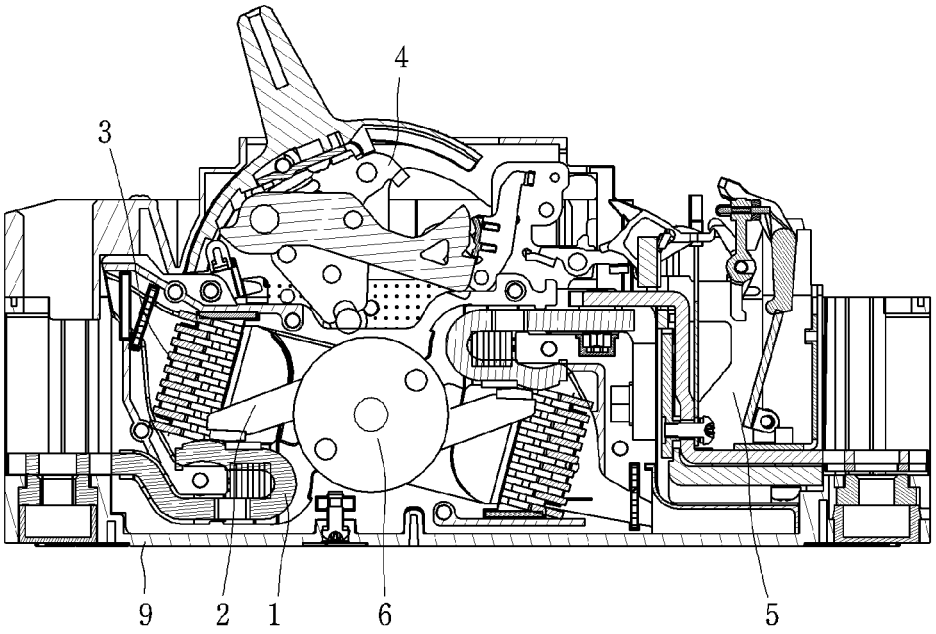
Fig. 1 Prior Art
FIG. 1 is an internal structural view illustrating a molded case circuit breaker according to the related art.
Figure 2:
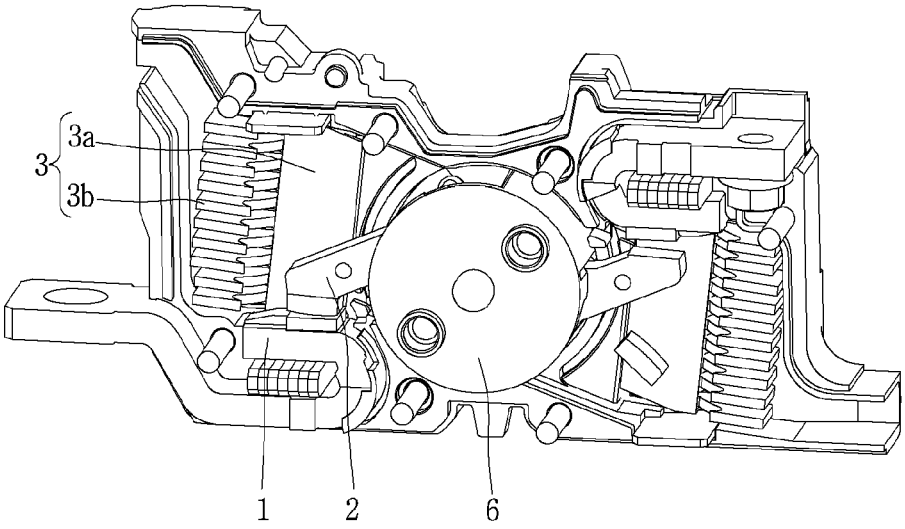
Fig. 2 Prior Art
Figure 3:
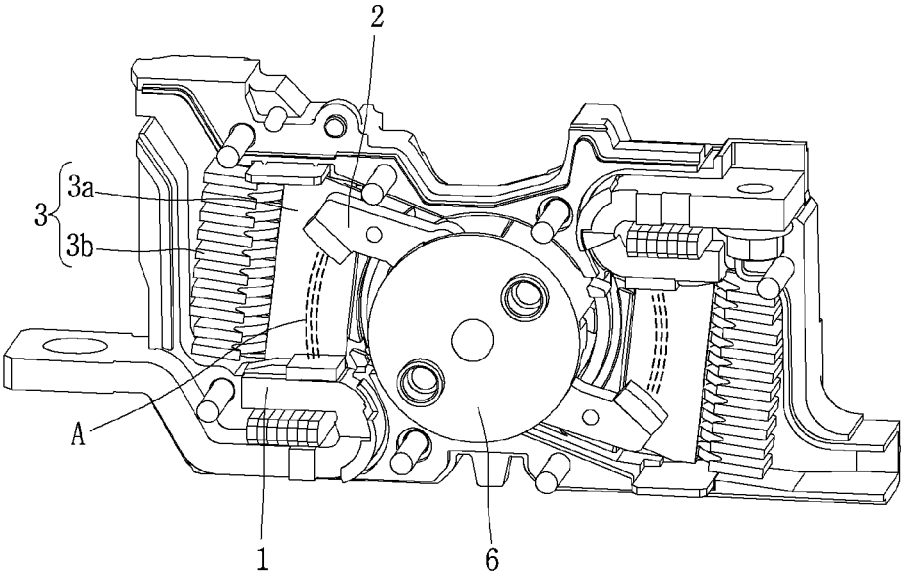
Fig. 3 Prior Art
Figure 4:
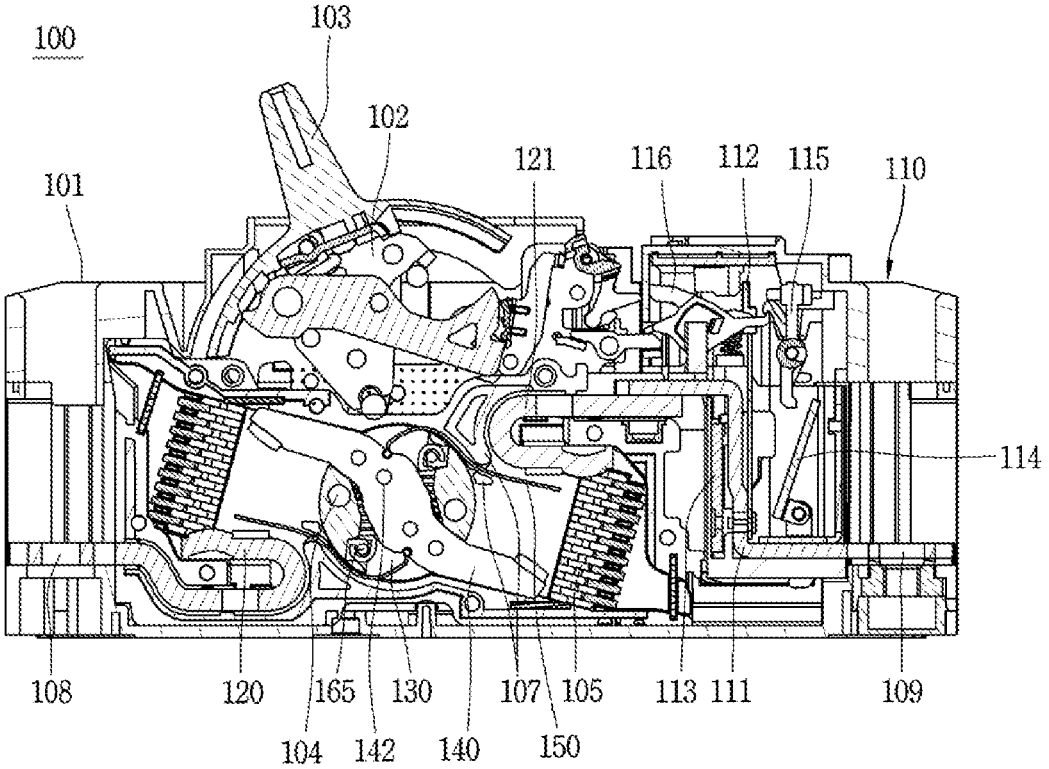
FIG. 4 is an internal structural view illustrating a molded case circuit breaker according to an embodiment of the present disclosure.
Figure 5:
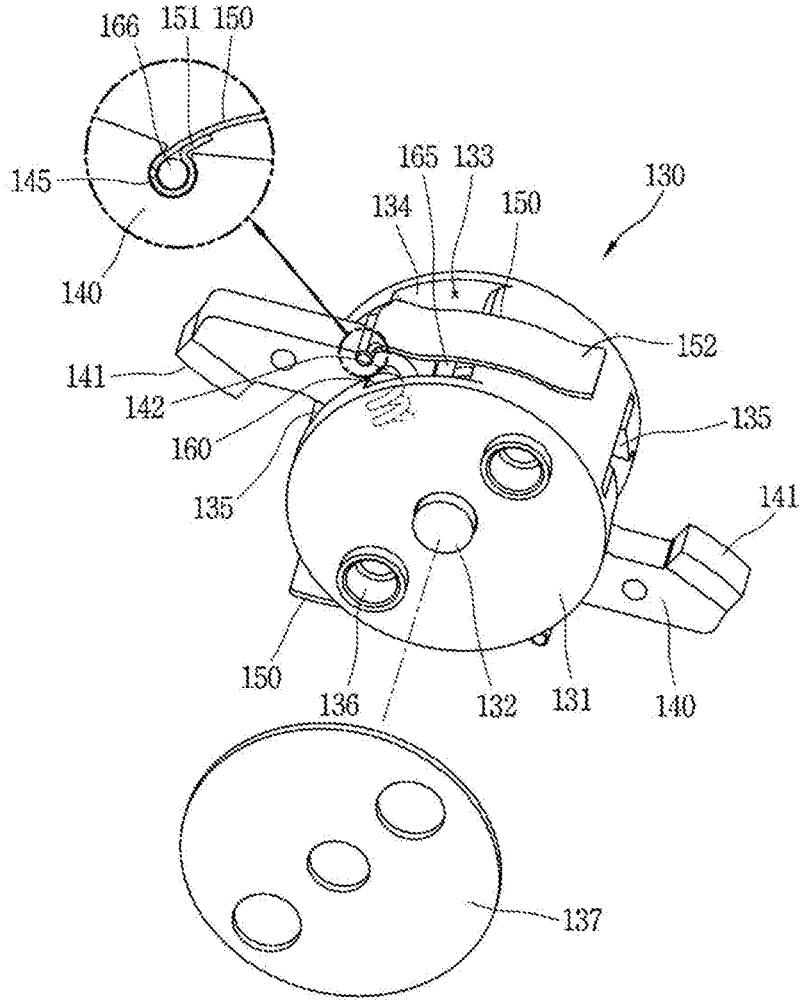
FIG. 5 is a perspective view of a shaft assembly in FIG. 4.
Figure 6:
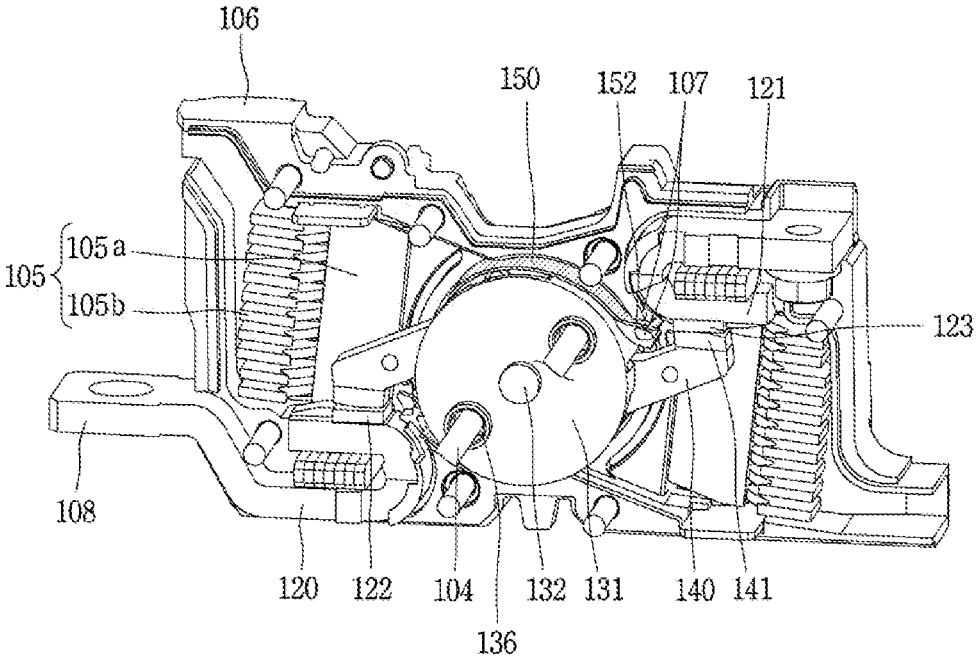
Figure 7:
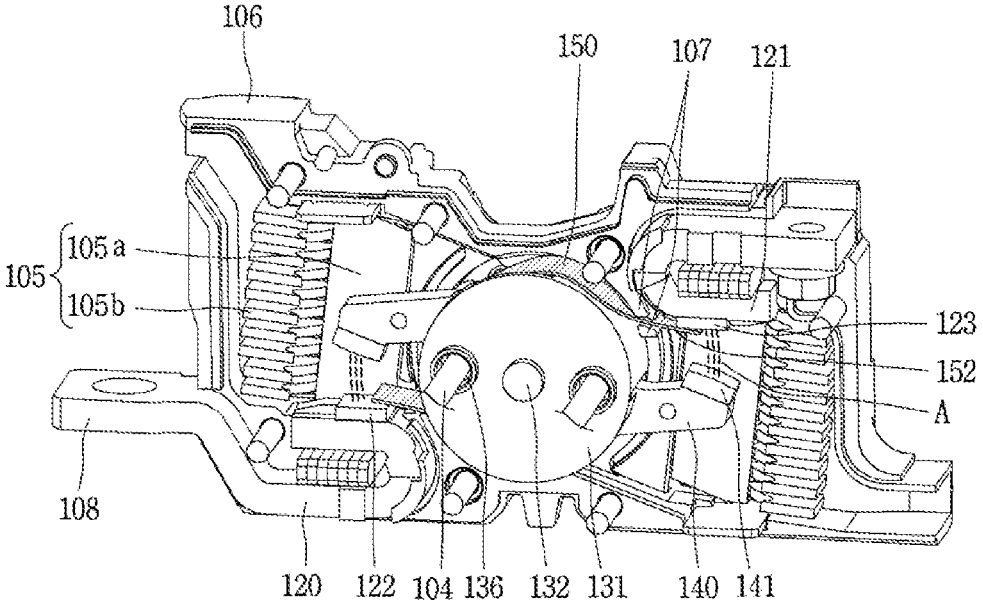
Figure 8:
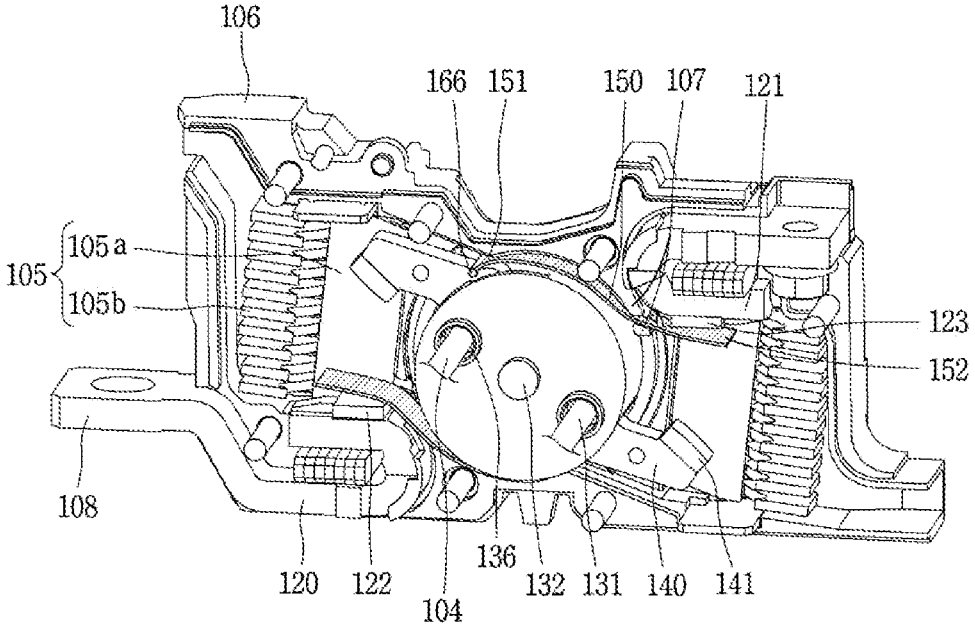

FIG. 4 is an internal structural view illustrating a molded case circuit breaker according to an embodiment of the present disclosure, and FIG. 5 is a perspective view of a shaft assembly in FIG. 4. FIGS. 6 through 8 are perspective views of a base assembly of a molded case circuit breaker according to an embodiment of the present disclosure, in which an interruption process is shown. FIGS. 6 through 8 show a conduction state, an interruption operation progress state, and an interruption complete state, respectively.

A molded case circuit breaker according to an embodiment of the present disclosure includes fixed contacts 120, 121; a movable contact 140 rotatably provided on a shaft body 131 to be brought into contact with or separated from the fixed contacts 120, 121; and an insulating barrier 150 entering between the fixed contacts 120, 121 and the movable contact 140 during interruption, and the insulating barrier 150 is coupled to the movable contact rotate along a circumferential surface of the shaft body 131.

First, the molded case circuit breaker 100 in a first embodiment will be described.

A case 101 accommodates and supports the components of the molded case circuit breaker. The case 101 is formed in a substantially box shape. A handle 103 is exposed on an upper surface of the case 101. The handle 103 operates a switching mechanism 102 by a user's manual operation force.

Terminal portions 108, 109 capable of being connected to a power source or a load are provided on front and rear surfaces of the case 101. The terminal portions 108, 109 are provided for each phase (or for each pole). For example, in the case of a three-phase four-pole molded case circuit breaker, four terminal portions may be provided on the power source side and the load side, respectively.

Fixed contacts 120, 121 are fixedly provided inside the case 101. The fixed contacts 120, 121 are connected to the terminal portions 108, 109, respectively. In the case of a double molded case circuit breaker, the fixed contacts 120, 121 are provided on a power source side and a load side thereof, respectively. In other words, a power source side fixed contact 120 and a load side fixed contact tip 121 are provided. At this time, the power source side fixed contact 120 may be directly connected to or integrally formed with the power source side terminal portion 108. The load side fixed contact tip 121 may be connected to the load side terminal portion 109 through a trip mechanism (particularly, a heater 111).

In the vicinity of the contact unit (fixed contact and movable contact), an arc-extinguishing unit (arc-extinguishing device) 105 is provided to extinguish an arc generated during interruption. In the case of a double molded case circuit breaker (double circuit breaker), the arc-extinguishing units 105 are provided on a power source side and a load side thereof, respectively. The arc-extinguishing unit 105 may be configured with a pair of side walls 105*a* and a plurality of grids 105*b* coupled to the side walls 105*a* at predetermined intervals.

A trip unit 110 that detects an abnormal current flowing through a circuit and tripping the switching mechanism is provided in a part of the case 101. The trip portion 110 is usually provided on the load side. The trip unit 110 may include a heater 111 connected to the load side terminal unit 109, a bimetal 112 coupled to the heater 111 to sense heat so as to be bent according to the amount of heat, a magnet and an amateur 114 provided around the heater 111, a crossbar 115 provided to rotate by the contact of the bimetal 112 and the armature 113, and a shooter 116 restrained or released by the rotation of the crossbar 115 to restrain or release a nail (not shown) of the switching mechanism 102. Typically, the bimetal 112 is bent by heat generated from the heater 111 to rotate the crossbar 115 so as to operate the switching mechanism 102 during small current delay interruption, and the crossbar 115 rotates while the armature 114 is sucked by a magnetic force excited in the magnet 113 to operate the switching mechanism 102 during a large current during large current instant interruption.

The user's operation force is transferred to the switching mechanism 102 through the handle 103. A pair of rotation pins 104 are provided on the switching mechanism 102 to transfer the power of the switching mechanism 102 to each phase. The rotation pin 104 is formed to have a length across all phases and provided in the shaft assembly (or mover assembly) 130.

The shaft assembly 130 is provided. The shaft assembly 130 is provided with a rotation pin 104 passing therethrough. The shaft assembly 130 receives the switching power of the switching mechanism 102 by the rotation pin 104 to rotate. As the shaft assembly 130 rotates, the movable contact 140 also rotates to be brought into contact with or separated from the fixed contacts 120, 121.

The shaft assembly 130 includes a shaft body 131, a movable contact 140, a shaft pin 165, a spring 160, a shaft insulating plate 137, and an insulating barrier 150.

The shaft body 131 is formed in a cylindrical shape. A shaft 132 is protruded on both flat side surfaces (disk surfaces) of the shaft body 131. An opening portion 133 is formed through the shaft body 131 in a direction perpendicular to the direction of the shaft 132. A pin mounting groove 134 into which the shaft pin 165 can be inserted and fixed is formed on an inner wall of the shaft body 131. A mover seating groove 135 in which the movable contact 140 is inserted and seated in a normal state is formed at one side of the opening 133 A pair of pinholes 136 through which the rotation pin 104 can be inserted are formed in the shaft body 131 in parallel to a direction of the shaft 132.

The movable contact 140 is inserted into the opening 133 of the shaft body 131. The movable contact 140 is brought into contact with or separated from the fixed contacts 120, 121 while rotating with the shaft body 131 or independently in a counterclockwise or clockwise direction to conduct or cut off the line.

Movable contact tip 141 that can be brought into contact with the fixed contact tips 122, 123 of the fixed contacts 120, 121, respectively, are provided at both end portions of the movable contact 140. The Movable contact tip 141 may be made of a conductive and durable material such as a chrome-copper (Cr—Cu) alloy.

A fixing protrusion 142 capable of hanging one end of the spring 160 is protruded on a side surface of the movable contact 140. One end of the spring 160 is fixed to the fixing protrusion 142, and thus the movable contact 140 is subjected to a force that rotates in a counterclockwise direction in the drawing. Accordingly, the movable contact 140 maintains the state of being inserted into the mover seating groove 135 of the shaft body 131 by an elastic force of the spring 160, unless an external force acts on the movable contact 140.

The movable contact 140 rotates together with the shaft body 131 in the case of a general small current or large current interruption situation, but the movable contact 140 rotates independently by a sudden electromagnetic repulsion force during cold current interruption. In this case, the movable contact 140 comes into contact with the shaft pin 165 of the opening portion 133 to stop the rotation. An engaging groove (not shown) that can be brought into contact with the shaft pin 165 may be formed on a rear surface of the movable contact 140.

A fitting groove 145 capable of fixing the insulating barrier 150 is formed on a rear surface of the movable contact 140.

The rotation of the movable contact 140 may be divided into three cases. A first case is a case where the user operates the handle 103 to allow the switching mechanism 102 connected to the handle 103 to rotate the shaft assembly 130 (refer to FIGS. 6 through 8) so that the movable contact 140 rotates together with the shaft body 131. In other words, the movable contact 140 is restrained by a force of the spring 160 to move together with the shaft body 131. In other words, in this case, the shaft assembly 130 moves the movable contact 140 and the shaft body 131 together.

A second case is a case where the operation of the trip unit 110 according to the detection of a fault current releases the restraint to the switching mechanism 102 so that the movable contact 140 rotates. while the shaft assembly 130 rotates (similarly, refer to FIGS. 6 through 8). Even at this time, the movable contact 140 is restrained by a force of the spring 160 to move together with the shaft body 131.

A third case is a case where when a large fault current such as a short-circuit current is generated, the movable contact 140 is separated from the fixed contacts 120, 121 and rotated by an electromagnetic repulsive force (so-called cold current interruption). At this time, the movable contact 140 rotates independently of the shaft body 131 in a separate manner. The movable contact 140 moves within the opening portion 133 of the shaft body 131. When the movable contact 140 moves in a clockwise direction against an elastic force of the spring 160 due to a strong electromagnetic repulsive force, 120, 121, the movable contact 140 moves out of the mover seat groove 135 and the movable contact 140 is separated from the fixed contact 140. The movable contact 140 is separated from the fixed contacts 120, 121 and the movable contact 140 is fixed in contact with the shaft pin 165. In other words, in this case (in the case of cold current interruption), in the shaft assembly 130 only the movable contact 140 independently moves while the shaft body 131 does not rotate.

The insulating barrier 150 is coupled to the movable contact 140. The insulating barrier 150 is coupled to a rear surface of the movable contact 140. One end of the insulating barrier 150 is coupled to a rear surface of the movable contact 140, and the other end thereof forms a free end with no restraint.

The manner in which the insulating barrier 150 is coupled to the movable contact 140 may be achieved by a variety of known coupling methods such as bonding, welding, fitting coupling, and pin coupling. In the present embodiment, the insulating barrier 150 is pin-coupled to a rear surface of the movable contact 140 as an example. A state is illustrated in which a fitting groove 145 is formed on a rear surface of the movable contact 140, and one end portion of the insulating barrier 150 is fitted and coupled to the fitting groove 145 by a fixing pin 166.

Here, the fitting groove 145 has a circular portion having a larger diameter than the fixing pin 166 and an opening portion in which part of the circular portion is open when viewed from the side. A width of the opening portion is formed smaller than a diameter of the circular portion. Therefore, the fixing pin 166 has to be pushed in from a lateral side of the fitting groove 145 and does not deviate in a rear surface direction (opening portion direction). One end portion 151 of the insulating barrier 150 is inserted into the opening portion.

At this time, the one end portion 151 of the insulating barrier 150 may be coupled thereto in a state that the fixing pin 166 is rolled (wound). As a result, the coupling force is increased.

The insulating barrier 150 is made of a member made of an insulating material. For such an example, a teflon-based material or an insulating sheet such as Nomax may be used. The insulating barrier 150 is formed of a material having flexibility. A degree of the flexibility may be adjusted to such an extent that it can be bent by an external force. In other words, as long as an external force does not act, the insulating barrier 150 may maintain a shape of surrounding an outer circumferential surface of the shaft body 131, and may be bent by being brought into contact with a guide portion 107 or the like.

The insulating barrier 150 may be formed in a plate shape.

The insulating barrier 150 is disposed in a shape of surrounding an outer circumferential surface of the shaft body 131 in a normal state (conduction state). At this time, the other end (free end) 152 of the insulating barrier 150 exists in a state of being slightly lifted up (spaced apart) from the shaft body 131 by the guide portion 107 (refer to FIG. 6).

The insulating barrier 150 rotates together with the movable contact 140 during interruption. Accordingly, the insulating barrier 150 is guided by the guide portion 107 to enter the fixed contacts 120, 121 and the movable contact 140 from the other end 152 of the insulating barrier 150. Therefore, an arc generated between the fixed contacts 120, 121 and the movable contact 140 during interruption is rapidly extinguished.

The insulating barrier 150 quickly enters at the time of interruption, and enters between the fixed contact tips 122, 123 and the Movable contact tip 141 before the movable contact 140 is fully open, thus performing the role of extinguishing an arc prior to arc extinguishing due to the arc-extinguishing unit 105. A pair of shaft pins 165 are provided. The shaft pin 165 is inserted into the pin mounting groove 134.

Two pairs of springs 160 are provided. Each pair of springs 160 is provided between each fixing protrusion 142 and each shaft pin 165. One end of the spring 160 is fixed to the fixing protrusion 142 and the other end thereof is fixed to the shaft pin 165. The movable contact 140 is in a state in contact with the mover seat groove 135 of the shaft body 131 due to a tensile force of the spring 160.

The guide portion 107 is formed in part of the base mold 106 forming an outer shape of the base assembly. The guide portion 107 is provided adjacent to the shaft body 131 between the movable contact 140 and the fixed contacts 120, 121. The guide portion 107 may be formed with a pair of protrusions spaced apart at a predetermined interval. At this time, a separation distance between the pair of protrusions is greater than a thickness of the insulating barrier 150. The insulating barrier 150 may be inserted between the guide portions 107. The guide portion 107 guides the movement of the insulating barrier 150.

Referring to FIGS. 6 through 8, the operation of a molded case circuit breaker according to a first embodiment of the present disclosure will be described.

FIG. 6 shows a conduction state. The shaft assembly 130 is placed in a state of being rotated in a counterclockwise direction. In other words, the shaft body 131 and the movable contact 140 are placed in a state of being rotated in a counterclockwise direction. The movable contact 140 is brought into contact with the fixed contacts 120, 121 to conduct a circuit. The insulating barrier 150 is placed in a state of being wrapped around a circumferential surface of the shaft body 131. The insulating barrier 150 closes the opening portion 133 of the shaft body 131 at least partly. The other end portion 152 of the insulating barrier 150 is placed on any one protrusion of the guide portion 107.

FIG. 7 shows an interruption operation progress state. The rotation pin 104 rotates in a clockwise direction by the power of the switching mechanism 102 when a small or large current is interrupted. The rotation pin 104 rotates the shaft body 131 to allow the shaft assembly 130 to rotate in a single body. The movable contact 140 is divided into fixed contacts 120, 121. As the movable contact 140 rotates, the insulating barrier 150 is guided by the guide portion 107 to enter the space between the fixed contact tips 122, 123 and the Movable contact tip 141 to suppress an arc (A) generated between the contact portions at an initial stage. The arc (A) is divided and interrupted by the insulating barrier 150.

FIG. 8 shows an interruption complete state. The shaft assembly 130 rotates and the movable contact 140 is placed as far as possible away from the fixed contacts 120, 121. The insulating barrier 150 enters between the guide portions 107 to completely cover the fixed contact tips 122, 123. A residual arc that is not extinguished by the insulating barrier 150 in the arc (A) is induced to the grids 105*b* of the arc-extinguishing unit 105 to completely disappear.

Figure 9:
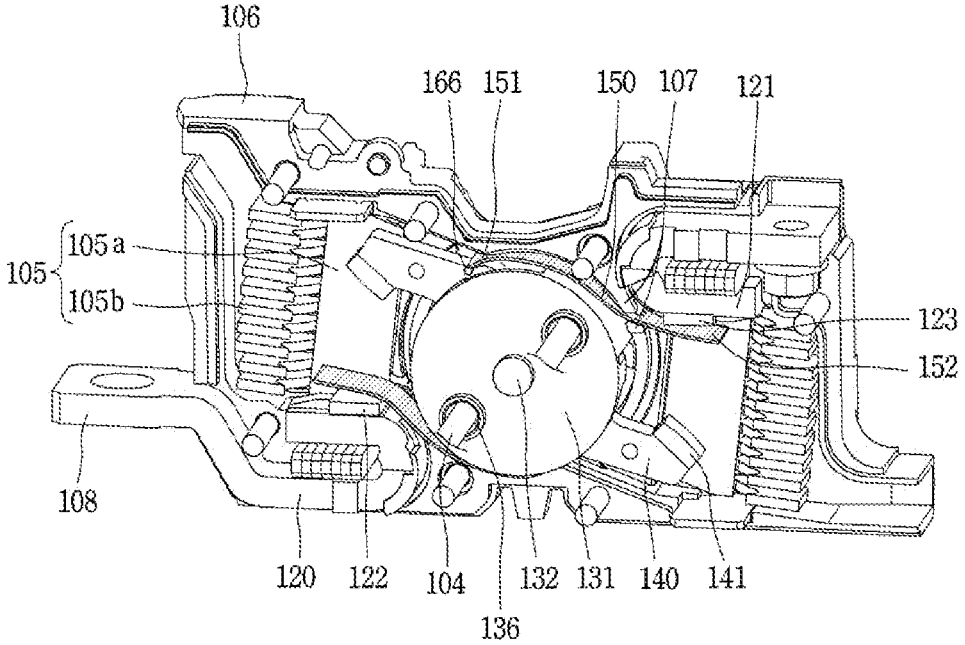
FIG. 9 is a perspective view of a base assembly of a molded case circuit breaker according to an embodiment of the present disclosure, in which a cold current interruption state is shown.

FIG. 9 shows an operation during cold current interruption. In the normal state of FIG. 6, when a sharp electromagnetic repulsion force acts on the contact portions 122, 123, 141 due to a short-circuit current, the movable contact 140 is separated from the fixed contacts 120, 121 while the shaft body 131 is fixed. At this time, the insulating barrier 150 coupled to the movable contact 140 enters between the fixed contact tips 122, 123 and the Movable contact tip 141 to interrupt an arc.

Figure 10:
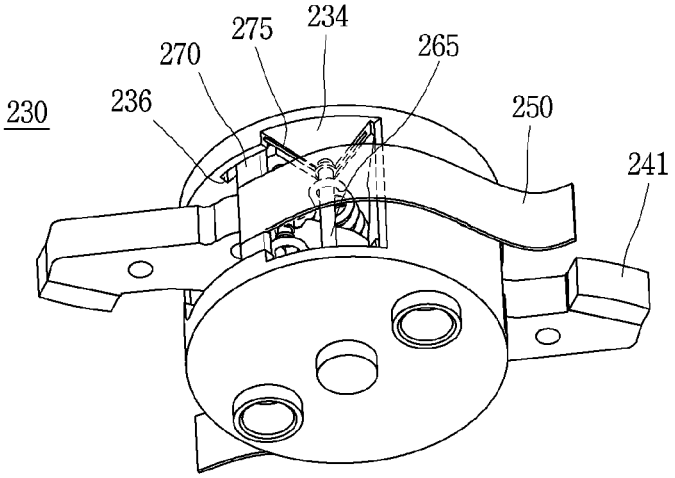
FIG. 10 is a perspective view illustrating a shaft assembly of a molded case circuit breaker according to another embodiment of the present disclosure.

A shaft assembly 230 according to another embodiment of the present disclosure is illustrated in FIG. 10. The shaft assembly 130 and other parts of the previous embodiment will be described.

In the present embodiment, a plate groove 236 is formed adjacent to a pin insertion groove 234 of the opening portion 233 in the shaft body 231. The plate groove 236 may be formed along a circumferential surface of the shaft body 231. In other words, the plate groove 236 may be formed to be slightly smaller than a radius of the outer peripheral surface of the shaft body 231. One end of the plate groove 236 communicates with the pin insertion groove 234.

A contact plate 270 is provided. The contact plate 270 is inserted into the plate groove 236 and formed to move in a sliding manner. In other words, the contact plate 270 may be formed as a flat plate. At this time, a cross-sectional area of the contact plate 270 may be formed with a curvature radius equal to a curvature radius of the plate groove 236.

One side surface of the contact plate 270 may be brought into contact with or fitted into the fitting groove 245 of the movable contact 240. The contact plate 270 may be pushed by the movable contact 240 to move.

An elastic member 275 is provided to transfer the contact plate 270 to a position in a normal state (a state of being brought into contact with the movable contact, a counterclockwise direction in the drawing). The elastic member 275 may support the other side surface of the contact plate 270. The elastic member 275 may include a torsion spring. The elastic member 275 may be inserted into the pin mounting groove 234. At this time, a center coil portion of the elastic member 275 may be fitted into the shaft pin 265. The contact plate 270 receives a force by the elastic member 275 in a direction of being brought into contact with the movable contact 240.

One end portion 251 of the insulating barrier 250 is coupled to the contact plate 270.

The operation of the present embodiment is similar to that of the previous embodiment. The shaft assembly 230 rotates to allow the insulating barrier 250 to enter between the movable contact 240 and the fixed contacts 220, 121 so as to interrupt an arc in a preemptive manner during general interruption, and the movable contact 240 pushes the contact plate 270 to allow the insulating barrier 250 to enter between the movable contact 240 and the fixed contacts 220, 121 during cold current interruption.

Figure 11:
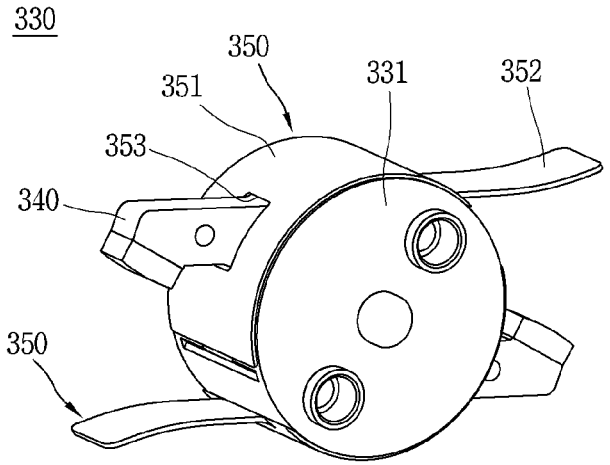
Figure 12:
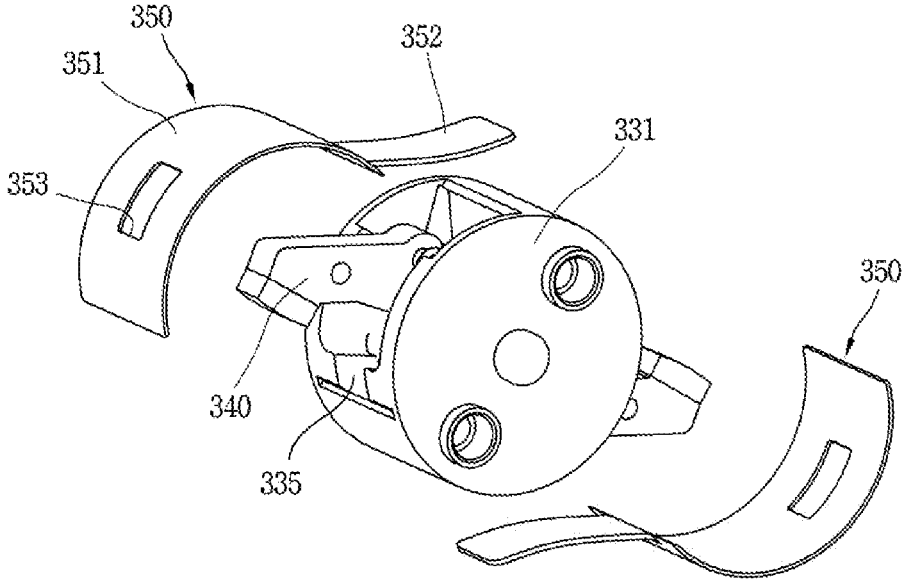

FIG. 11 is a perspective view illustrating a shaft assembly of a molded case circuit breaker according to still another embodiment of the present disclosure. FIG. 12 illustrates a state in which an insulating barrier 350 is separated in FIG. 11.

The other components (parts) of the shaft assembly 330 excluding the insulating barrier 350 in the present embodiment may be configured in the same manner as in the first embodiment.

The insulating barrier 350 may include a cover portion 351 and an arc interrupting portion 352 connected to a rear end of the cover portion 351. Here, the cover portion 351 may be formed to have a size that completely covers the opening portion 333 of the shaft body 331. In other words, a length of the cover portion 351 may be formed larger than that of an arc from the mover seating groove 335 to a rear end surface of the opening portion 333 on a circumferential surface of the shaft body 331. Accordingly, the insulating barrier 350 completely covers the opening portion 333 of the shaft body 331.

A mover insertion hole 353 is formed in the cover portion 351. The movable contact 340 is exposed through the mover insertion hole 353 of the insulating barrier 350. A fixing groove (not shown) may be formed in the movable contact 340 to fit the cover portion 351 thereinto.

The arc interrupting portion 352 enters between the fixed contacts 320, 321 and the movable contact 340 to interrupt an arc.

The operation of this embodiment is as follows. First, a typical interruption operation of a small or large current is similar to the first embodiment, and thus detailed description thereof will be omitted.

Figure 13:
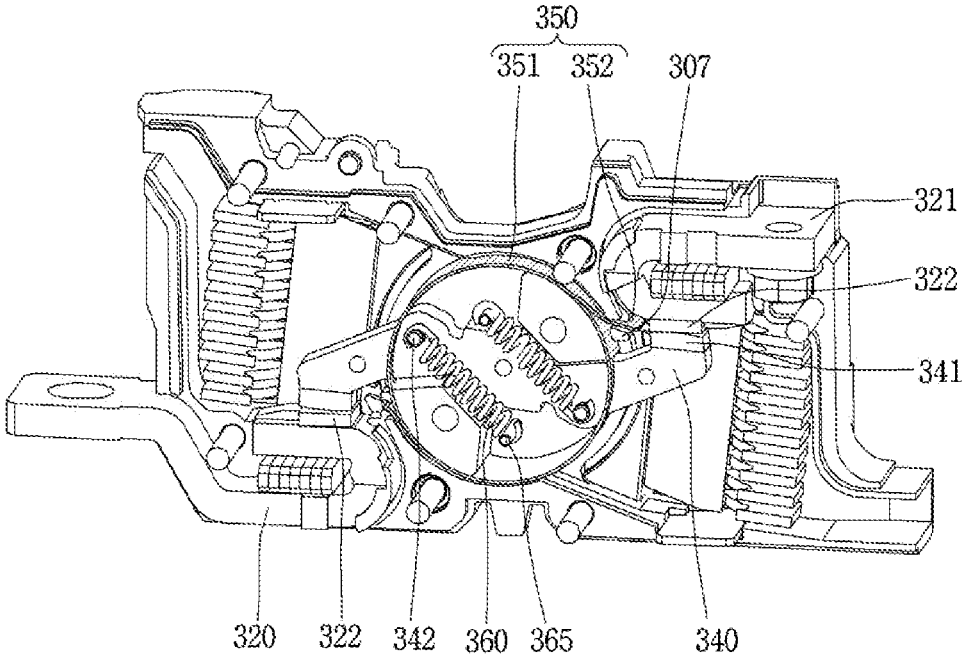
Figure 14:
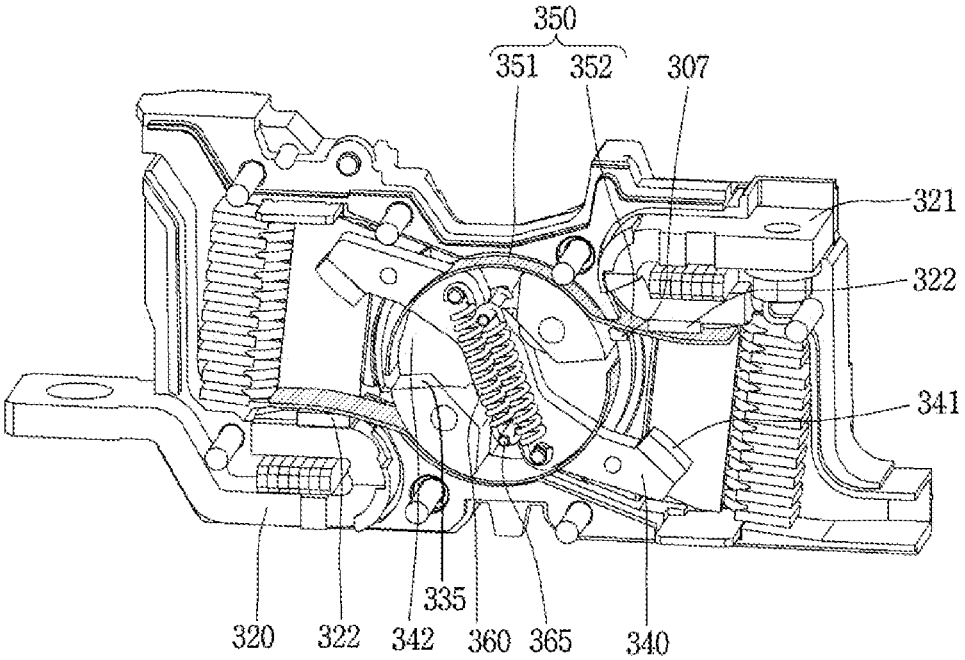

FIGS. 13 and 14 illustrate an interruption operation during cold current interruption in a molded case circuit breaker according to this embodiment. FIG. 13 shows a conduction state, and FIG. 14 shows an interruption state.

In a conduction state, the movable contact 340 is restrained by a force of the spring 360 to receive a counterclockwise force and thus in a state of being brought into contact with the fixed contacts 320, 321. Here, the spring 360 is provided between the fixing protrusion 342 of the movable contact 340 and the shaft pin 365 of the shaft body 331 as described above. At this time, when a sharp electromagnetic repulsive force acts on the contact portions 322, 323, 341 due to a short-circuit current, the movable contact 340 is separated from the fixed contacts 320, 321 against a force of the spring 360 while the shaft body 331 is fixed. At this time, the arc interrupting portion of the insulating barrier 350 coupled to the movable contact 340 enters between the fixed contacts 322, 323 and the movable contact 341 to interrupt an arc.

Figure 15:
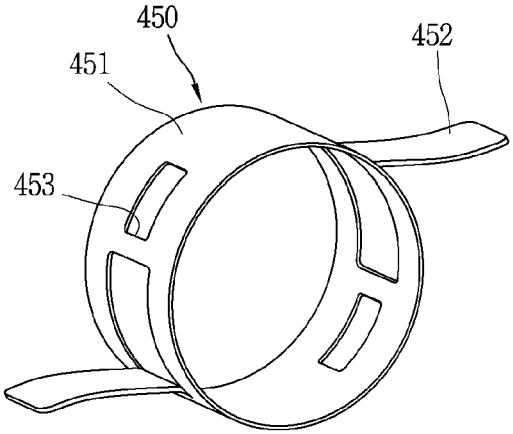
FIG. 15 is a cross-sectional view illustrating an insulating barrier according to still another embodiment of the present disclosure.

FIG. 15 is a cross-sectional view illustrating an insulating barrier according to still another embodiment of the present disclosure.

For the insulating barrier 450 in this embodiment, the insulating barriers 350 of the previous embodiment are not divided into a pair but integrally connected. The cover portion 451 of the insulating barrier 150 is formed in a ring shape to cover an entire circumferential surface of the shaft body 131. A mover insertion hole 453 is formed in the cover portion 451. A part of the cover portion 451 is cut to form an arc interrupting portion 452.

Since the insulating barrier 450 of this embodiment is integrally formed, it is not necessary to be restrained to the movable contact 340.

The operation of this embodiment is the same as that of the previous embodiment, and thus detailed description thereof will be omitted.

The above-described embodiments, which are embodiments for implementing the present disclosure, are only illustrative and not limitative to the concept of the present invention, and the scope of the concept of the invention is not limited by those embodiments. In other words, the scope protected by the present disclosure should be construed by the accompanying claims, and all the technical concept within the equivalent scope of the invention should be construed to be included in the scope of the right of the present disclosure.

What is the claimed is:

1. A molded case circuit breaker, comprising:

a fixed contact;

a movable contact configured to be brought into contact with or separated from the fixed contact;

an insulating barrier configured to enter between the fixed contact and the movable contact during interruption, wherein the insulating barrier comprises a free end portion and is formed of a flexible material, and a guide portion protruded on part of a base mold and configured to guide the free end portion of the insulating barrier, wherein the insulating barrier is coupled to the movable contact to rotate along a circumferential surface of a shaft body, wherein the guide portion comprises a pair of protrusion portions spaced apart from each other, wherein when an external force does not act on the insulating barrier, the insulating barrier is configured to maintain a shape of surrounding the circumferential surface of the shaft body, and be bent by being brought into contact with the guide portion, and wherein when the movable contact is connected to the fixed contact, the free end portion of the insulating barrier is configured to be lifted up from the shaft body by the guide portion.

2. The molded case circuit breaker of claim 1, wherein a fitting groove is formed on a rear surface of the movable contact, and one end portion of the insulating barrier is fitted and coupled to the fitting groove by a fixing pin.

3. The molded case circuit breaker of claim 1, wherein a circumferential groove-shaped plate groove is formed on the shaft body, and a contact plate sliding along the plate groove is provided in the plate groove.

4. The molded case circuit breaker of claim 3, wherein the plate groove is formed smaller than a radius of the circumferential surface of the shaft body.

5. The molded case circuit breaker of claim 3, wherein an elastic member providing an elastic force in a direction in which the contact plate is brought into contact with the movable contact is provided in a pin insertion groove of the shaft body.

6. The molded case circuit breaker of claim 1, wherein the insulating barrier comprises a cover portion covering an opening portion of the shaft body and an arc interrupting portion extended to one end of the cover portion.

7. The molded case circuit breaker of claim 6, wherein a mover insertion hole into which the movable contact is configured to be inserted is formed on the cover portion.

8. A molded case circuit breaker, comprising:

a fixed contact;

a movable contact configured to be brought into contact with or separated from the fixed contact; and an insulating barrier configured to enter between the fixed contact and the movable contact during interruption, wherein the insulating barrier is coupled to the movable contact to rotate along a circumferential surface of a shaft body, wherein a circumferential groove-shaped plate groove is formed on the shaft body, and a contact plate sliding along the plate groove is provided in the plate groove.

9. The molded case circuit breaker of claim 8, wherein the plate groove is formed smaller than a radius of the circumferential surface of the shaft body.

10. The molded case circuit breaker of claim 8, wherein an elastic member providing an elastic force in a direction in which the contact plate is brought into contact with the movable contact is provided in a pin insertion groove of the shaft body.

11. A molded case circuit breaker, comprising:

a fixed contact;

a movable contact configured to be brought into contact with or separated from the fixed contact; and an insulating barrier configured to enter between the fixed contact and the movable contact during interruption, wherein the insulating barrier is coupled to the movable contact to rotate along a circumferential surface of a shaft body, wherein the insulating barrier comprises a cover portion covering an opening portion of the shaft body and an arc interrupting portion extended to one end of the cover portion, wherein a mover insertion hole into which the movable contact is configured to be inserted is formed on the cover portion.

* * * * *